US009488191B2

(12) United States Patent
Matys

(10) Patent No.: US 9,488,191 B2
(45) Date of Patent: Nov. 8, 2016

(54) GAS TURBINE DIFFUSER STRUT INCLUDING COANDA FLOW INJECTION

(71) Applicant: Pawel Matys, Jupiter, FL (US)

(72) Inventor: Pawel Matys, Jupiter, FL (US)

(73) Assignee: Siemens Aktiengesellschaft, München (DE)

( * ) Notice: Subject to any disclaimer, the term of this patent is extended or adjusted under 35 U.S.C. 154(b) by 499 days.

(21) Appl. No.: 14/067,173

(22) Filed: Oct. 30, 2013

(65) Prior Publication Data

US 2015/0118015 A1 Apr. 30, 2015

(51) Int. Cl.

| | |
|---|---|
| ***F01D 25/30*** | (2006.01) |
| ***F01D 5/14*** | (2006.01) |
| ***F04D 29/54*** | (2006.01) |

(52) U.S. Cl.

CPC ..... *F04D 29/542* (2013.01); *F01D 5/146* (2013.01); *F01D 25/305* (2013.01); *F05D 2270/173* (2013.01)

(58) Field of Classification Search

None

See application file for complete search history.

(56) References Cited

U.S. PATENT DOCUMENTS

| | | | | |
|---|---|---|---|---|
| 2,907,557 | A | 10/1959 | Coanda | |
| 2,988,303 | A | 6/1961 | Coanda | |
| 3,830,450 | A | 8/1974 | Williams et al. | |
| 6,200,092 | B1 | 3/2001 | Koschier | |
| 6,334,753 | B1 * | 1/2002 | Tillman | B64C 21/04 415/1 |
| 6,997,676 | B2 * | 2/2006 | Koshoffer | F01D 5/146 415/115 |
| 2003/0059291 | A1 | 3/2003 | Koshoffer et al. | |
| 2008/0134685 | A1 | 6/2008 | Bunker et al. | |
| 2009/0263243 | A1 | 10/2009 | Little et al. | |
| 2011/0058939 | A1 | 3/2011 | Orosa et al. | |
| 2012/0186261 | A1 | 7/2012 | Toprani et al. | |
| 2013/0031913 | A1 | 2/2013 | Little | |
| 2013/0152592 | A1 | 6/2013 | Orosa et al. | |

FOREIGN PATENT DOCUMENTS

| | | |
|---|---|---|
| EP | 1413713 A2 | 4/2004 |
| EP | 2613024 A2 | 7/2013 |
| EP | 2634381 A1 | 9/2013 |

* cited by examiner

*Primary Examiner* — Igor Kershteyn
*Assistant Examiner* — Justin Seabe

(57) ABSTRACT

An exhaust diffuser comprising an inner boundary and an outer boundary forming an annular gas path, and a plurality of strut structures extending radially within the gas path. Each of the strut structures include pressure and suction side walls, and a plurality of radially spaced flow injectors are formed in at least one of the pressure and suction side walls for injecting a fluid flow into the gas path adjacent to the strut structure. At least two fluid supply conduits provide a fluid flow to respective radially spaced flow injectors, and a flow control device is associated with each of the conduits to independently control a fluid flow from a fluid source to each of the radially spaced flow injectors.

17 Claims, 4 Drawing Sheets

GAS TURBINE DIFFUSER STRUT INCLUDING COANDA FLOW INJECTION

FIELD OF THE INVENTION

The invention relates in general to turbine engines and, more particularly, to exhaust diffusers for turbine engines.

BACKGROUND OF THE INVENTION

Referring to FIG. 1, a turbine engine 10 generally includes a compressor section 12, a combustor section 14, a turbine section 16 and an exhaust section 18. In operation, the compressor section 12 can induct ambient air and can compress it. The compressed air from the compressor section 12 can enter one or more combustors 20 in the combustor section 14. The compressed air can be mixed with the fuel, and the air-fuel mixture can be burned in the combustors 20 to form a hot working gas. The hot gas can be routed to the turbine section 16 where it is expanded through alternating rows of stationary airfoils and rotating airfoils and used to generate power that can drive a rotor 26. The expanded gas exiting the turbine section 16 can be exhausted from the engine 10 via the exhaust section 18.

The exhaust section 18 can be configured as a diffuser 28, which can be a divergent duct formed between an outer shell 30 and a center body or hub 32 and a tail cone 34 supported by support struts 36. The exhaust diffuser 28 can serve to reduce the speed of the exhaust flow and thus increase the pressure difference of the exhaust gas expanding across the last stage of the turbine. In some prior turbine exhaust sections, exhaust diffusion has been achieved by progressively increasing the cross-sectional area of the exhaust duct in the fluid flow direction, thereby expanding the fluid flowing therein, and is typically designed to optimize operation at design operating conditions. Additionally, gas turbine engines are generally designed to provide desirable diffuser inlet conditions at the design point, in which the exhaust flow passing from the turbine section 16 is typically designed to have radially balanced distributions of flow velocity and swirl.

Various changes in the operation of the gas turbine engine may result in less than optimum flow conditions at the diffuser inlet and, in particular, can result in radially distorted flow entering the diffuser. For example, operation at an off-design operating point, e.g., part load operation or an off-design ambient air inlet temperature, may result in a radially non-uniform velocity distribution entering the diffuser.

SUMMARY OF THE INVENTION

In accordance with an aspect of the invention, an exhaust diffuser is provided in a gas turbine engine. The exhaust diffuser comprises an inner boundary and an outer boundary forming an annular gas path, and a plurality of strut structures extend radially between the inner boundary and the outer boundary and are located within the gas path downstream of a last row of rotating blades. Each of the strut structures include pressure and suction side walls extending in a downstream axial direction from a leading edge toward a downstream trailing edge of the strut structure. A plurality of radially spaced flow injectors are formed in at least one of the pressure and suction side walls for injecting a fluid flow into the gas path adjacent to the strut structure. At least two fluid supply conduits are connected to provide a fluid flow to respective radially spaced flow injectors, and a flow control device is associated with each of the conduits to independently control a fluid flow from a fluid source to each of the radially spaced flow injectors.

Each of the flow injectors may discharge a flow of gas downstream substantially parallel to an outer surface of the at least one of the pressure and suction side walls to direct a portion of an exhaust flow passing over the strut structure toward a radial section of the strut structure associated with each of the flow injectors. The flow of gas from each of the flow injectors may produce a Coanda effect to entrain and accelerate a portion of the exhaust flow to result in substantially attached flow along the at least one of the pressure and suction side walls.

The two fluid supply conduits may include at least a first conduit supplying a fluid flow to a first flow injector adjacent to the inner boundary and a second conduit supplying a fluid flow to a second flow injector adjacent to the outer boundary. The first and second flow injectors may be elongated in a radial direction to provide a Coanda flow to radially extending sections of the at least one of the pressure and suction side walls, and each of the first and second flow injectors may be defined by a continuous elongated slot. Alternatively, each of the first and second flow injectors may be defined by a plurality of discrete openings. A further flow conduit may supply a fluid flow to a flow injector located radially midway between the first and second flow injectors.

The flow injectors may be located extending radially adjacent to the leading edge of the strut structure.

In accordance with another aspect of the invention, an exhaust diffuser is provided in a gas turbine engine. The exhaust diffuser comprises an inner boundary and an outer boundary forming an annular gas path, and a plurality of struts extend radially between the inner boundary and the outer boundary and are located within the gas path downstream of a last row of rotating blades. An airfoil shaped strut shield surrounds each of the struts, each of the strut shields including pressure and suction side walls extending in a downstream axial direction from a leading edge toward a downstream trailing edge of the strut shield. A plurality of radially spaced flow injectors are formed in the suction side wall. The flow injectors inject a fluid flow into the gas path adjacent to the strut shield to produce a Coanda jet flow adjacent to the suction side wall to entrain and accelerate a portion of the exhaust flow to result in substantially attached flow along the suction side wall. Each of the flow injectors are connected to a respective fluid supply conduit to provide a fluid flow to the flow injectors, and a flow control device is associated with each of the conduits to independently increase or decrease the mass flow rate of a fluid flow from a pressurized fluid source to the radially spaced flow injectors.

The fluid flow to the flow injectors may be changed to provide different mass flows along the radial extent of the strut shield, as an operating condition of the engine is changed.

In accordance with a further aspect of the invention, a method of controlling exhaust diffusion in a turbine engine is provided comprising the steps of: providing a turbine engine having a turbine section and an exhaust diffuser section, the exhaust diffuser section including an inner boundary and an outer boundary spaced radially from the inner boundary so that a flow path is defined therebetween, and strut structures extending radially through the flow path between the inner and outer boundaries, and the strut structures each including a pressure side wall and a suction side wall extending axially in a direction of flow through the flow path; supplying a flow of turbine exhaust gas to the flow path; supplying a first Coanda jet flow at a first mass flow rate along at least one of the pressure and suction side walls at a first location adjacent to the inner boundary; supplying a second Coanda jet flow at second mass flow rate along the at least one pressure and suction side wall at a second location radially outward from the first location; and wherein a fluid supply to the first Coanda jet flow is controlled separately from a fluid supply to the second Coanda jet flow.

The first mass flow rate of the first Coanda jet flow may be different than the second mass flow rate of the second Coanda jet flow.

The method may further include changing the mass flow rate of one of the first and second Coanda jet flows relative to the other of the first and second Coanda jet flows.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Embodiments of the invention are directed to an exhaust diffuser system, which can increase the power and efficiency of a turbine engine. In accordance with an aspect of an invention, a diffuser design is described to provide an improved diffuser performance by providing decreased flow separation at strut structures extending radially through a flow path defined through the diffuser. In particular, an improved attachment of flow around the strut structures during operation of the turbine engine at changing or different operating conditions provides an improved performance, with minimized or reduced pressure losses and increased diffuser pressure recovery.

Figure 1:
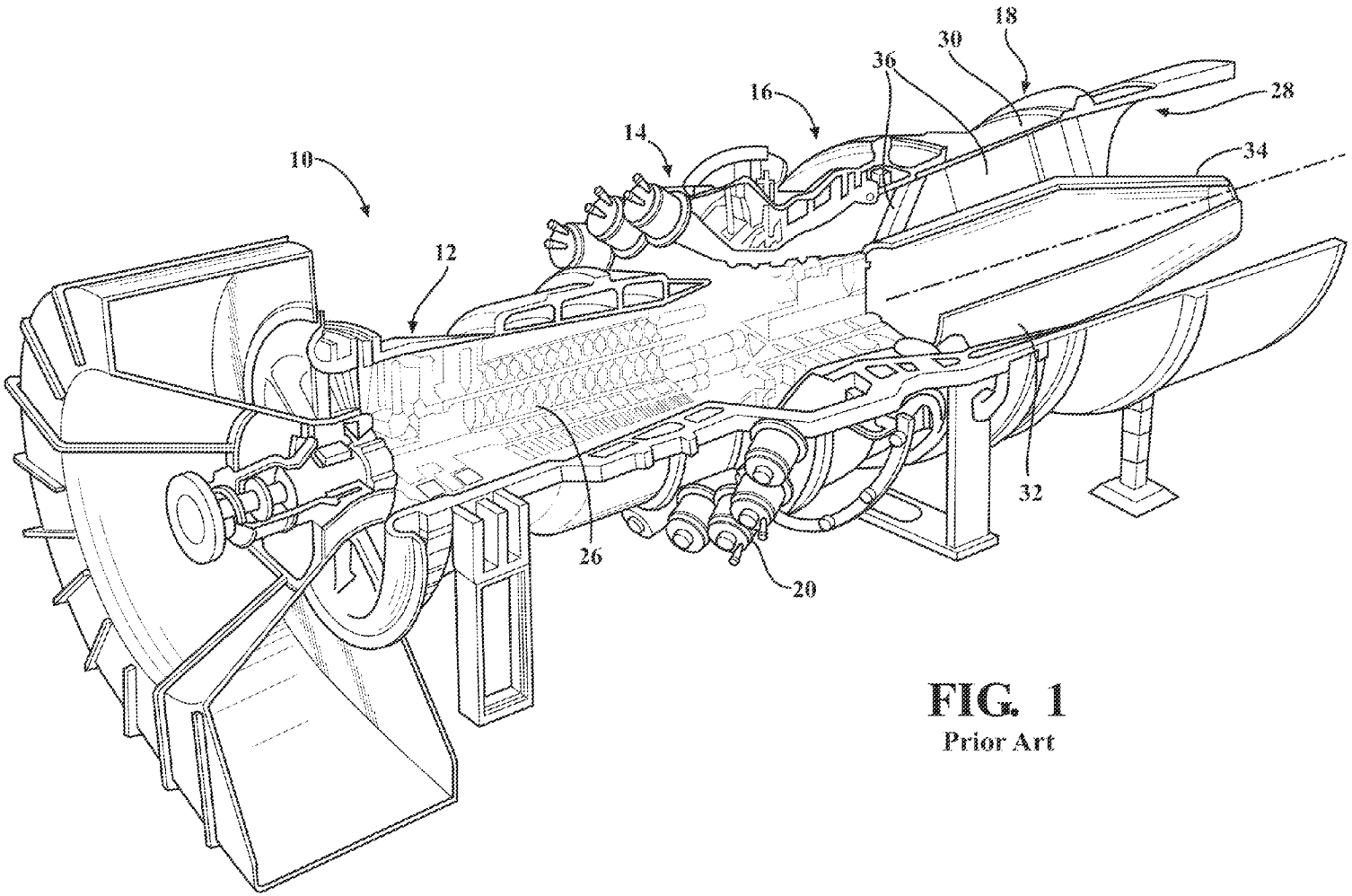
FIG. 1 Prior Art
FIG. 1 is a perspective view partially in cross-section of a known turbine engine.
Figure 2:
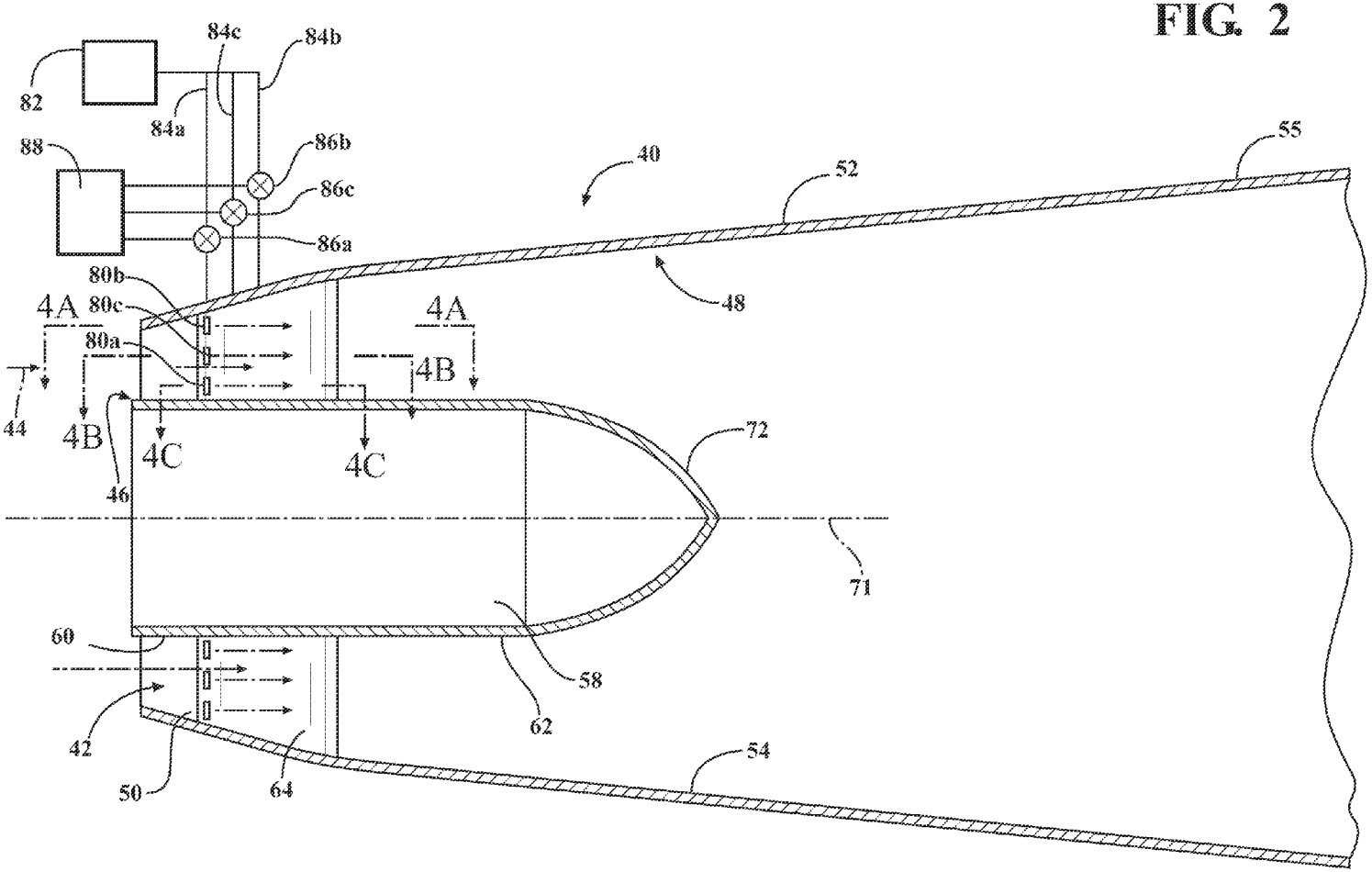
FIG. 2 is a side elevation cross-sectional view of an exhaust diffuser section of a turbine engine configured in accordance with aspects of the invention.

FIG. 2 shows a portion of an exhaust diffuser system 40 of a gas turbine engine configured in accordance with aspects of the invention. The exhaust diffuser 40 is downstream from a last row of rotating blades of a turbine section of the engine, which may correspond to the turbine section 16 of the engine 10 shown in FIG. 1. The exhaust diffuser 40 has an inlet 42 that can receive an exhaust flow or exhaust gases 44 exiting from the turbine section. The exhaust diffuser 40 includes an inner boundary 46, which may comprise an inner ring, and an outer boundary 48, which may comprise an outer ring. The outer boundary 48 is radially spaced from the inner boundary 46 such that a flow path 50 is defined between the inner and outer boundaries 46, 48. The flow path 50 can be generally annular or can have any other suitable configuration.

The outer boundary 48 is shown as comprising a diffuser shell 52 having an inner peripheral surface 54 defining the outer boundary 48 of the flow path 50. The diffuser shell 52 defines the axial length (only a portion of which is shown in FIG. 2) of the exhaust diffuser 40. The axial length extends from an upstream end 53 to a downstream end 55 of the diffuser shell 52.

The inner boundary 46 can be defined by a center body, also referred to as a hub 58. The hub 58 may be generally cylindrical and may include an upstream end 60 and a downstream end 62. The terms "upstream" and "downstream" are intended to refer to the general position of these items relative to the direction of fluid flow through the exhaust diffuser section 40. The hub 58 is interconnected and supported to the diffuser shell 52 by a plurality of radially extending strut structures 64, that may comprise a structural strut 66 surrounded by a strut liner or shield 68, as seen in FIG. 3, which are arranged in circumferential alignment in a row.

Referring to FIG. 2, the inner boundary 46 may also be defined by a tail cone 72. The tail cone 72 has an upstream end attached to the downstream end 62 of the hub 58 in any suitable manner. Preferably, the tail cone 64 tapers from the downstream end 62 of the hub 58 extending in the downstream direction. The hub 58 and the tail cone 64 can be substantially concentric with the diffuser shell 52 and can share a common longitudinal axis 71, corresponding to a central axis for the flow path 50. The inner surface 54 of the diffuser shell 52 is oriented to diverge from the longitudinal axis 71 in the downstream direction, such that at least a portion of the flow path 50 is generally conical.

Figure 5:
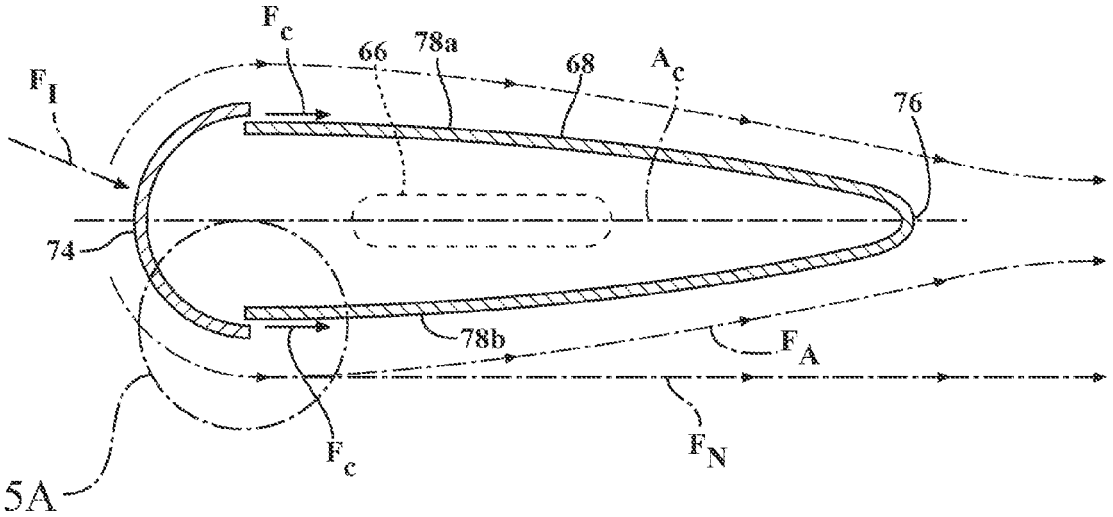
FIG. 5 is diagrammatic cross-sectional view illustrating exhaust gas flow around a strut structure.

Referring to FIG. 5, the strut shields 68 are formed with an aerodynamic airfoil shape. The illustrated strut shield 68 includes a leading edge 74 at an upstream end, a trailing edge 76 at a downstream end, and opposing sides, including a pressure side 78*a* and a suction side 78*b*, extending in an axial direction, i.e., in the direction of gas flow through the flow path 50, between the leading and trailing edges 74, 76. A chordal axis $A_C$ is defined by the opposing sides 78*a*, 78*b* extending in the downstream direction from the leading edge 74. The axial direction of the chordal axis $A_C$ may be parallel to the longitudinal axis 71, or may be angled relative to the longitudinal axis 71, as may be dictated by the particular structural and/or flow characteristics of the exhaust section.

Figure 3:
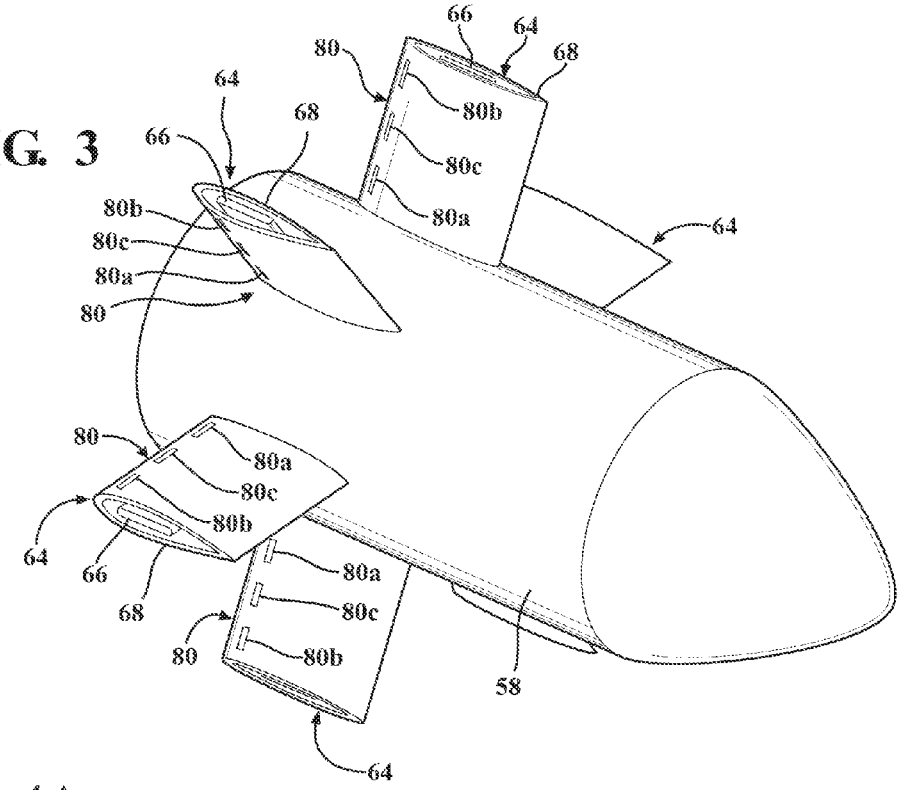
FIG. 3 is an enlarged perspective view of a diffuser hub including strut structure illustrating aspects of the invention.

As may be seen with reference to FIGS. 2 and 3, a plurality of radially spaced Coanda flow injectors 80 are formed in at least one of the pressure and suction side walls 78*a*, 78*b*, for injecting a fluid flow into the gas path adjacent to the strut structure 64. Specifically, in a particular embodiment, each strut structure 64 may include a first or radially inner flow injector 80*a*, a second or radially outer flow injector 80*b* and a third or intermediate flow injector 80*c* located between the first and second flow injectors 80*a*, 80*b*. The Coanda flow injectors 80 preferably include at least a first and second flow injector 80*a*, 80*b*, and may additionally include the third flow injector 80*c* for additional refinement in flow control as may be further understood from the following description.

Figure 5A:
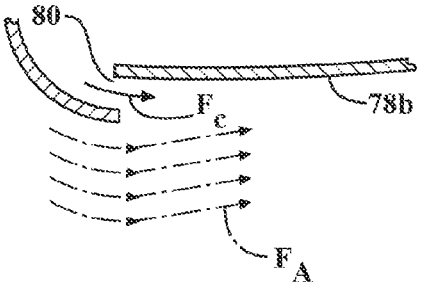
FIG. 5A is an enlarged view of the area 5A in FIG. 5, illustrating an area of Coanda flow along a strut structure.

The Coanda flow injectors 80 are provided with a supply of fluid, such as a supply of compressed air, to produce a Coanda effect or jet flow $F_C$ (FIG. 5A) that may comprises a thin jet sheet along the outer surface of the strut shield 68 to entrain and accelerate a portion of the exhaust flow 44 to turn circumferentially in substantially attached flow around or along the outer surface of the strut shield 68. As used herein, "Coanda effect" refers to the effect observed by Henri Coanda in the 1930's of the tendency of a relatively high speed jet of fluid flowing tangentially along a curved or inclined surface to follow the surface along the curve or incline.

A flow separation may typically occur on the suction side 78*b* of the strut structure 64, due to a circumferential component of the exhaust flow, as is illustrated by the incoming flow direction arrow $F_I$ in FIG. 5. In particular, under certain operating conditions, the normal flow $F_N$ along the suction side 78*b* may be separated from the surface of the strut shield 68, resulting in losses and reduced operating efficiency. Hence, the Coanda flow $F_C$ is produced in a downstream longitudinal or axial direction that is preferably initially substantially parallel to the surface of the strut shield 68 adjacent to the opening of the flow injectors 80 to direct a thin jet of fluid substantially tangent to surface of the strut shield 68, creating an attached flow, as is depicted by flow $F_A$ in FIG. 5. As the Coanda jet pressure is increased across the exit of the Coanda flow injectors 80, the turning performance of the thin jet sheet to flow along the surface of the strut shield 68 increases.

It may be noted that the Coanda flow injectors 80 may be defined by an upstream portion of the strut shield 68 overlapping an adjacent portion of the strut shield 68, i.e., the Coanda flow injectors 80 can be formed integrally in the structure of the strut shield 68, as depicted in FIG. 5. Alternatively, the Coanda flow injectors 80 can be a separately formed structure mounted to the strut shield 68.

In accordance with an aspect of the invention, the flow of fluid to each of the individual flow injectors 80*a*, 80*b*, 80*c* can be controlled to vary the Coanda effect radially or span-wise along the strut structure 64. As can be seen in FIG. 2, a fluid supply 82, such as a supply of pressurized gas, e.g., compressed air, can provide compressed fluid to the flow injectors 80*a*, 80*b*, 80*c* via respective fluid supply conduits 84*a*, 84*b*, 84*c*. The flow to the fluid supply conduits 84*a*, 84*b*, 84*c* can be selectively varied by respective valves 86*a*, 86*b*, 86*c* operating under control of a control device or controller 88. The controller 88 may be a processor associated with control of the engine operation As is further illustrated in FIGS. 4A-4C, each of the fluid supply conduits 84*a*, 84*b*, 84*c* may include a plenum 90*a*, 90*b*, 90*c* that can supply respective pairs of exit openings $\mathbf{80}a_P$ and $\mathbf{80}a_S$, $\mathbf{80}b_P$ and $\mathbf{80}b_S$, $\mathbf{80}c_P$ and $\mathbf{80}c_S$ associated with the pressure and suction side walls 78*a*, 78*b*. The plenums 90*a*, 90*b*, 90*c* are separated from each other, defining individually controlled pressurized fluid sources at the radial or span-wise locations of each of their respective pairs of exit openings $\mathbf{80}a_P$ and $\mathbf{80}a_S$, $\mathbf{80}b_P$ and $\mathbf{80}b_S$, $\mathbf{80}c_P$ and $\mathbf{80}c_S$. In this configuration, the fluid pressure supplied to the pairs of pressure and suction side exit openings at any given radial location of the flow injectors 80*a*, 80*b*, 80*c* will be equal.

Figure 4A:
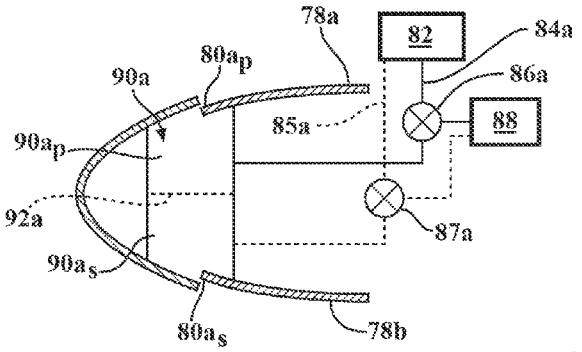
FIG. 4A is a diagrammatic cross-sectional view taken at line 4A-4A in FIG. 2.
Figure 4B:
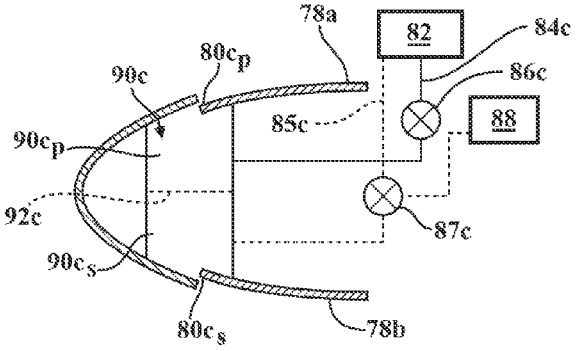
FIG. 4B is a diagrammatic cross-sectional view taken at line 4B-4B in FIG. 2.
Figure 4C:
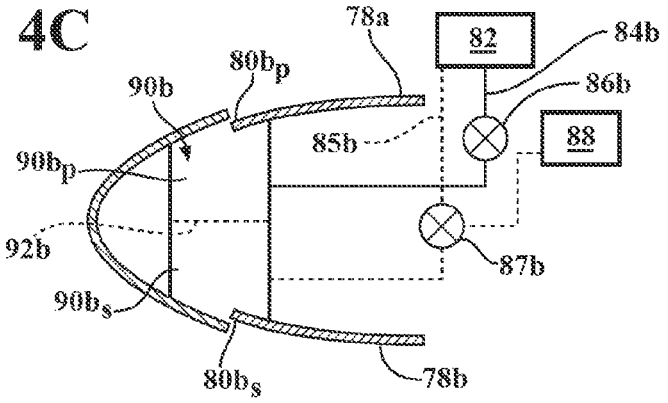
FIG. 4C is a diagrammatic cross-sectional view taken at line 4C-4C in FIG. 2.

It may be recognized that the Coanda flow requirement at the suction side wall 78*b* will typically be greater than the Coanda flow requirement at the pressure side wall 78*a*, in that substantially all flow separation typically occurs at the suction side 78*b*, as is illustrated by the flow line $F_N$ in FIG. 5. In accordance with a further aspect of the invention, different fluid flows may be provided to the pressure and suction side flow injectors 80*a*, 80*b*, 80*c* associated with the opposing pressure and suction side walls 78*a*, 78*b*. A configuration for providing separate Coanda flows to the pressure and suction side walls 78*a*, 78*b* is illustrated in FIGS. 4A-4C, where the plenums 90*a*, 90*b*, 90*c* may optionally include respective partitions 92*a*, 92*b*, 92*c* to form separate pairs of pressure and suction side sub-plenums $\mathbf{90}a_P$ and $\mathbf{90}a_S$, $\mathbf{90}b_P$ and $\mathbf{90}b_S$, $\mathbf{90}c_P$ and $\mathbf{90}c_S$, feeding the respective pairs of exit openings $\mathbf{80}a_P$ and $\mathbf{80}a_S$, $\mathbf{80}b_P$ and $\mathbf{80}b_S$, $\mathbf{80}c_P$ and $\mathbf{80}c_S$. An additional flow of compressed fluid may be provided to each of the plenums 90*a*, 90*b*, 90*c* via respective additional fluid conduits 85*a*, 85*b*, 85*c* and associated flow control valves 87*a*, 87*b*, 87*c*. as depicted by dotted lines, and operating under control of the controller 88. Hence, a different fluid pressure may be provided to each of the different pressure and suction side sub-plenums $\mathbf{90}a_P$ and $\mathbf{90}a_S$, $\mathbf{90}b_P$ and $\mathbf{90}b_S$, $\mathbf{90}c_P$ and $\mathbf{90}c_S$ wherein a higher pressure may be provided to the suction side sub-plenums $\mathbf{90}a_S$, $\mathbf{90}b_S$, $\mathbf{90}c_S$ than to the pressure side sub-plenums $\mathbf{90}a_P$, $\mathbf{90}b_P$, $\mathbf{90}c_P$, and in certain operating conditions it may not be necessary to provide a compressed fluid for a Coanda flow to the pressure side sub-plenums $\mathbf{90}a_P$, $\mathbf{90}b_P$, $\mathbf{90}c_P$.

It should be noted that the described configurations provide control over the mass flow of compressed fluid forming the Coanda flow at different radial locations, i.e., the mass flow rate of compressed fluid to one flow injector may be changed relative to the mass flow rate to any other flow injector, and may be used to improve the efficient use of compressed fluid supplied to the diffuser. Further, the mass flow of the fluid supplied to the Coanda flow injectors can be controlled to not exceed, or not substantially exceed, the amount of fluid flow required to improve attached flow of the exhaust gases along the strut structure 64. Hence, as the exhaust gas flow velocity magnitude, direction, swirl, and lateral/radial distribution can vary with varying engine operating conditions, e.g., with varying engine ambient inlet conditions and/or operation change of operation to part load, the Coanda flow provided to the flow injectors 80*a*, 80*b*, 80*c* can likewise be varied to match these span-wise exhaust gas flow variations, resulting in significant reductions in compressed fluid flow required to prevent separation.

In an alternative configuration, only suction side exit openings $\mathbf{80}a_S$, $\mathbf{80}b_S$, $\mathbf{80}c_S$ may be provided for producing a Coanda flow on only the suction side wall 78*b* of the strut structure 64. Since flow separation is typically observed along the suction side of the strut structure 64, advantages of the invention are substantially obtained by providing a Coanda flow out of the suction side exit openings $\mathbf{80}a_S$, $\mathbf{80}b_S$, $\mathbf{80}c_S$, such that the pressure side exit openings $\mathbf{80}a_P$, $\mathbf{80}b_P$, $\mathbf{80}c_P$ may not be required.

Although the Coanda flow injectors 80 can be provided at an axial location anywhere along the pressure and suction side walls 78*a*, 78*b* between the leading and trailing edges 74, 76, a preferred location is adjacent to the leading edge 74, such as at or adjacent to a location where flow separation initially occurs. The pairs of exit openings $\mathbf{80}a_P$ and $\mathbf{80}a_S$, $\mathbf{80}b_P$ and $\mathbf{80}b_S$, $\mathbf{80}c_P$ and $\mathbf{80}c_S$ forming the flow injectors 80*a*, 80*b*, 80*c* can be defined by elongated slots, i.e., a continuous elongated slot for each of the flow injectors. Alternatively, the flow injectors 80*a*, 80*b*, 80*c* can each be defined by a plurality of discrete openings on the pressure and suction side walls 78*a*, 78*b*.

Although three flow injectors 80*a*, 80*b*, 80*c* are described, the invention also contemplates providing as few as two flow injectors, i.e., the first and second flow injectors 80*a*, 80*b*, where the mass flow through the first flow injector 80*a* controls flow separation along a radially inner span-wise section of the strut structure 64, e.g., adjacent to the inner boundary 46, and the mass flow through the second flow injector 80*b* separately controls flow separation along a radially outer span-wise section of the strut structure 64, e.g., adjacent to the outer boundary 48. Additional flow injectors, such as the intermediate flow injector 80*c* may be included to provide further refinement of the flow control by supplying a span-wise varying Coanda flow along the strut structure 64, as defined by the different flow injectors 80*a*, 80*b*, 80*c*. Further, it should be understood that the presently described configurations for the Coanda flow injector 80 are provided for illustrative purposes, such that a greater number than three flow injectors may be provided, and other compressed fluid supply and conduit configurations may also be provided.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An exhaust diffuser for a gas turbine engine, comprising:

an inner boundary and an outer boundary forming an annular gas path;

a plurality of strut structures extending radially between the inner boundary and the outer boundary and located within the gas path downstream of a last row of rotating blades of the gas turbine engine;

each of the strut structures including pressure and suction side walls extending in a downstream axial direction from a leading edge toward a downstream trailing edge of the strut structure;

a plurality of radially spaced flow injectors formed in at least one of the pressure and suction side walls, the flow injectors injecting a respective fluid flow into the gas path adjacent to the strut structure, the flow injectors being oriented so as to direct the respective fluid flow substantially parallel to an outer surface of the at least one of the pressure and suction side walls in a direction along an exhaust flow, producing a Coanda jet flow adjacent to the at least one of the pressure and suction side walls, to entrain and accelerate a portion of the exhaust flow to result in substantially attached flow along the at least one of the pressure and suction side walls; and at least two fluid supply conduits connected to provide a fluid flow to respective radially spaced flow injectors, and a flow control device associated with each of the conduits to independently control a fluid flow from a fluid source to each the radially spaced flow injectors, the radially spaced flow injectors being associated with respective plenums within the strut structure which are separated from each other.

2. The exhaust diffuser of claim 1, wherein the at least two fluid supply conduits include at least a first conduit supplying a fluid flow to a first flow injector adjacent to the inner boundary and a second conduit supplying a fluid flow to a second flow injector adjacent to the outer boundary.

3. The exhaust diffuser of claim 2, wherein the first and second flow injectors are elongated in a radial direction to provide a Coanda flow to radially extending sections of the at least one of the pressure and suction side walls.

4. The exhaust diffuser of claim 3, wherein each of the first and second flow injectors are defined by a continuous elongated slot.

5. The exhaust diffuser of claim 3, wherein each of the first and second flow injectors are defined by a plurality of discrete openings.

6. The exhaust diffuser of claim 2, including a further flow conduit supplying a fluid flow to a flow injector located radially midway between the first and second flow injectors.

7. The exhaust diffuser of claim 3, wherein the flow injectors are located extending radially adjacent to the leading edge of the strut structure.

8. An exhaust diffuser for a gas turbine engine, comprising:

an inner boundary and an outer boundary forming an annular gas path;

a plurality of struts extending radially between the inner boundary and the outer boundary and located within the gas path downstream of a last row of rotating blades of the gas turbine engine;

an airfoil shaped strut shield surrounding each of the struts, each of the strut shields including pressure and suction side walls extending in a downstream axial direction from a leading edge toward a downstream trailing edge of the strut shield;

a plurality of radially spaced flow injectors formed in the suction side wall, the flow injectors injecting a respective fluid flow into the gas path adjacent to the strut shield, the flow injectors being oriented so as to direct the respective fluid flow substantially parallel to an outer surface of the suction side wall in a direction along an exhaust flow, to produce a Coanda jet flow adjacent to the suction side wall to entrain and accelerate a portion of the exhaust flow to result in substantially attached flow along the suction side wall; and each of the radially spaced flow injectors are connected to a respective fluid supply conduit to provide a fluid flow to the flow injectors, and a flow control device associated with each of the conduits to independently increase or decrease the mass flow rate of a fluid flow from a pressurized fluid source to the radially spaced flow injectors, the radially spaced flow injectors being associated with respective plenums within the strut structure which are separated from each other.

9. The exhaust diffuser of claim 8, wherein the flow injectors are elongated in a radial direction to provide a Coanda flow to radially extending sections of the suction side wall.

10. The exhaust diffuser of claim 9, wherein each of the first and second flow injectors are defined by a continuous elongated slot.

11. The exhaust diffuser of claim 9, wherein each of the first and second flow injectors are defined by a plurality of discrete openings.

12. The exhaust diffuser of claim 8, wherein the control devices are configured to change the fluid flow to the flow injectors to provide different mass flows along the radial extent of the strut shield, as an operating condition of the engine is changed.

13. The exhaust diffuser of claim 8, wherein the flow injectors are located extending radially adjacent to the leading edge of the strut shield.

14. A method of exhaust diffusion in a turbine engine comprising the steps of:

providing a turbine engine having a turbine section and an exhaust diffuser section, the exhaust diffuser section including an inner boundary and an outer boundary spaced radially from the inner boundary so that a flow path is defined therebetween, and strut structures extending radially through the flow path between the inner and outer boundaries, the strut structures each including a pressure side wall and a suction side wall extending axially in a direction of flow through the flow path and a plurality of radially spaced flow injectors formed in at least one of the pressure and suction side walls;

supplying a flow of turbine exhaust gas to the flow path;

supplying a first Coanda jet flow through a first flow injector of the plurality of flow injectors, at a first mass flow rate along said at least one of the pressure and suction side walls at a first location adjacent to the inner boundary;

supplying a second Coanda through a second flow injector of the plurality of flow injectors, jet flow at second mass flow rate along said at least one of the pressure and suction side walls at a second location radially outward from the first location;

wherein the first and second Coanda jet flows are substantially parallel to an outer surface of said at least one of the pressure and suction side walls in a direction along an exhaust flow, wherein a fluid supply to the first Coanda jet flow is controlled separately from a fluid supply to the second Coanda jet flow, the first and second flow injectors being associated with respective plenums within the strut structure which are separated from each other.

15. The method of claim 14, wherein the first mass flow rate of the first Coanda jet flow is different than the second mass flow rate of the second Coanda jet flow.

16. The method of claim 15, including changing the mass flow rate of one of the first and second Coanda jet flows relative to the other of the first and second Coanda jet flows.

17. The method of claim 14, wherein the first and second Coanda jet flows exit from the strut structure at a location adjacent to an upstream leading edge of the strut structure.

* * * * *